US011771149B2

(12) United States Patent
Klakring

(10) Patent No.: US 11,771,149 B2
(45) Date of Patent: Oct. 3, 2023

(54) NURSING GARMENT

(71) Applicant: Lou Lou & Company, LLC, Provo, UT (US)

(72) Inventor: Karen Klakring, Provo, UT (US)

(73) Assignee: Lou Lou and Company, Provo, UT (US)

( * ) Notice: Subject to any disclaimer, the term of this patent is extended or adjusted under 35 U.S.C. 154(b) by 0 days.

(21) Appl. No.: 17/394,632

(22) Filed: Aug. 5, 2021

(65) Prior Publication Data

US 2022/0061415 A1 Mar. 3, 2022

Related U.S. Application Data

(63) Continuation of application No. 17/005,138, filed on Aug. 27, 2020, now Pat. No. 11,096,432.

(51) Int. Cl.
*A41D 1/215* (2018.01)

(52) U.S. Cl.
CPC ..... *A41D 1/215* (2018.01)

(58) Field of Classification Search
CPC ..... A41D 1/215; A41D 1/21
USPC ..... 2/104
See application file for complete search history.

(56) References Cited

U.S. PATENT DOCUMENTS 3,311,926 A * 4/1967 Gerber ..... A41B 1/10 2/96
6,647,552 B1 * 11/2003 Hogan ..... A41D 13/1245 2/114
2004/0177429 A1 * 9/2004 Sanders ..... A41D 1/215 2/104
2014/0173809 A1 * 6/2014 Partsch, IV ..... A41B 1/20 2/255

* cited by examiner

*Primary Examiner* — Timothy K Trieu

(57) ABSTRACT

A nursing garment in the style of a dress is disclosed. In some embodiments, the nursing garment may comprise a dress body having a front and a back. The dress body may comprise a neck opening, a left arm opening, a right arm opening, a legs opening, an upper placket, and a lower placket. The upper placket may comprise at least one buttonhole. The lower placket may comprise at least one button operable to couple with the at least one buttonhole. The dress body may further comprise a first zipper member coupled to either or the upper placket and the front. The dress body may further comprise a second zipper member coupled to the lower placket. The second zipper member may be operable to couple with the first zipper member. The upper placket and the lower placket may be separable to allow an infant to nurse.

18 Claims, 5 Drawing Sheets

NURSING GARMENT

BACKGROUND

Breastfeeding and nursing newborns and infants can be a critical part of providing for children. Breastfeeding can be stressful and challenging, and many traditional articles of clothing make breastfeeding difficult. Breastfeeding in public often requires a woman to retreat to a designated area where there may be some privacy to breastfeed, however, such areas often do not exist.

Many existing garments design for breastfeeding are cumbersome, difficult to use in the intended manner, or do not provide a desired amount of coverage during breastfeeding or adequate coverage of a woman's post-pregnancy body.

SUMMARY

Embodiments of the invention include a nursing garment in the style of a dress. The nursing garment may comprise a dress body having a front and a back. The dress body may comprise a neck opening, a left arm opening, a right arm opening, a legs opening, an upper placket, and a lower placket. The upper placket may comprise at least one buttonhole. The lower placket may comprise at least one button operable to couple with the at least one buttonhole. The dress body may further comprise a first zipper member coupled to either or the upper placket and the front. The dress body may further comprise a second zipper member coupled to the lower placket. The second zipper member may be operable to couple with the first zipper member. The upper placket and the lower placket may be separable to allow an infant to nurse.

Embodiments may further include a nursing garment in the style of a dress. The nursing garment may comprise a front and a back coupled to the front. The front and the back may be coupled to form a neck opening, a left arm opening, a right arm opening, and a legs opening. The nursing garment may comprise a placket coupled to the front. The placket may comprise an upper placket. The upper placket may comprise at least one buttonhole. The placket may comprise a lower placket. The lower placket may comprise at least one button operable to couple with the at least one buttonhole. The nursing garment may further comprise a first zipper member. The first zipper member may be coupled to either or the upper placket and the front. The nursing garment may further comprise a second zipper member coupled to the lower placket. The second zipper member may be operable to couple with the first zipper member. The upper placket and the lower placket may be separable in a manner to allow an infant to nurse.

Embodiments may further include a nursing garment in the style of a dress. The nursing garment may comprise a dress body having a front and a back coupled together. The dress body may comprise a neck opening, a left arm opening, a right arm opening, a legs opening. The dress body may comprise an upper placket and a lower placket. The upper placket may comprise at least a first buttonhole. The lower placket may comprise at least a first button operable to couple with the at least a first buttonhole. The dress body may further comprise a first zipper member coupled to either or the upper placket and the front. The dress body may further comprise a second zipper member coupled to the lower placket. The second zipper member may be operable to couple with the first zipper member. The upper placket and the lower placket may be separable in a manner to allow an infant to nurse.

The various embodiments described in the summary and this document are provided not to limit or define the disclosure or the scope of the claims.

DETAILED DESCRIPTION

A nursing garment is described. These examples and embodiments are provided solely to add context and aid in the understanding. The disclosed embodiments may be practiced without some or all of the specific details described in this document. In some instances, well-known concepts and garment components have not been described in detail in order to avoid unnecessarily obscuring the description. Other applications and examples are possible, such that the following examples, illustrations, and contexts should not be taken as definitive or limiting either in scope or setting. Although these embodiments are described in sufficient detail to enable one skilled in the art to practice the invention, these examples, illustrations, and contests are not limiting, and other embodiments may be used and changes may be made without departing from the spirit and scope of the invention.

Some embodiments include a nursing garment in the style of a dress or a shirt. The various figures show a nursing garment that does not have the appearance of being a traditional nursing garment and may maximize the coverage of a woman's breast while breastfeeding or nursing a child. Some embodiments of a nursing garment may have the appearance of a regular garment, while having the functionality of allowing a woman to breastfeed or nurse a child.

Figure 1:
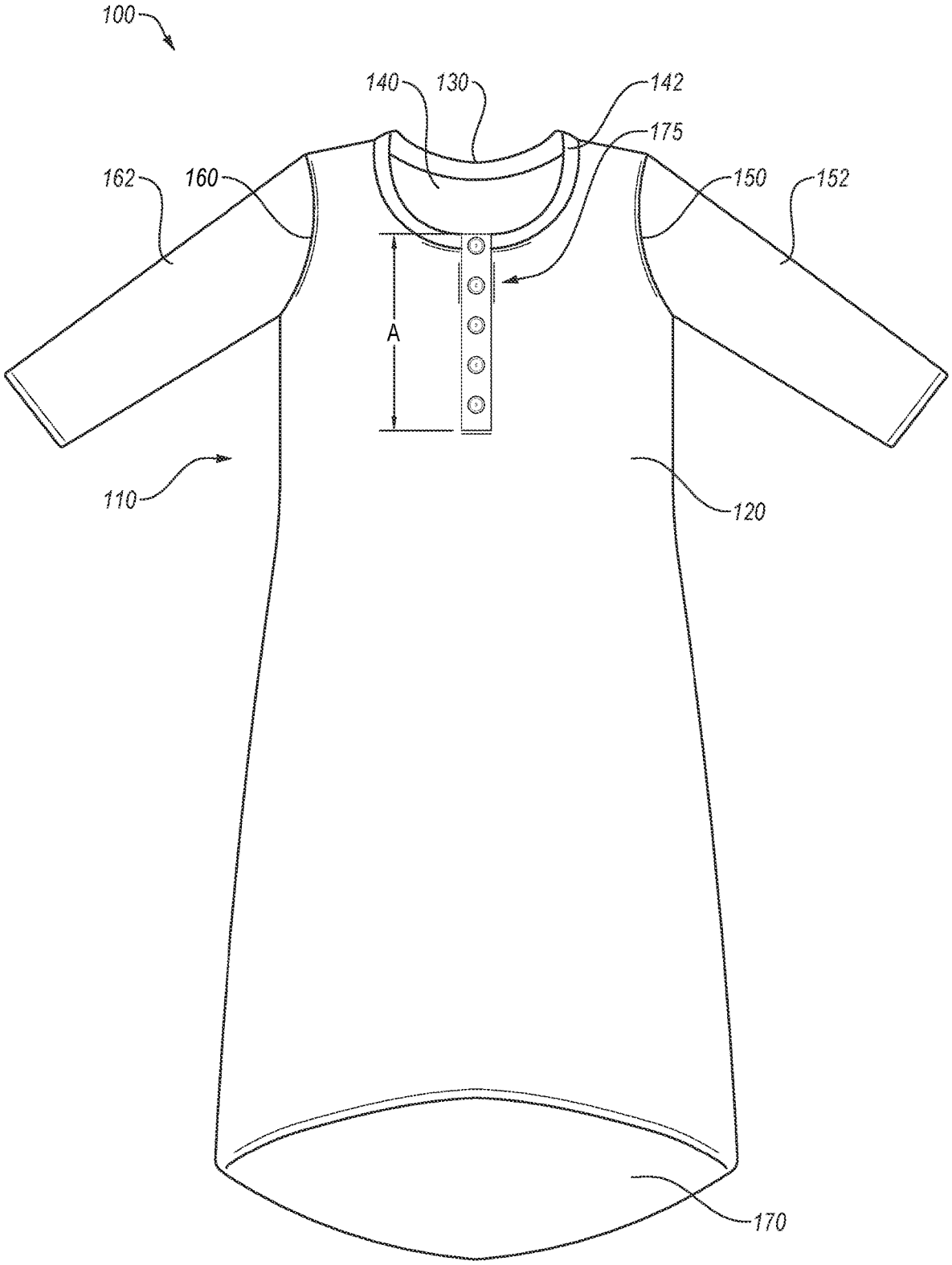
FIG. 1 is a frontal view of a nursing garment in accordance with some embodiments described in this document.

Some embodiments include a nursing garment 100 in the style of a dress, as illustrated in FIG. 1. The nursing garment 100 may comprise a dress body 110. The dress body 110 may comprise a front 120 coupled to a back 130. In some embodiments, the front 120 may be coupled to the back 130. The front 120 may be coupled to the back 130 via stitching or other methods known in the art.

In some embodiments the dress body 110 may include a neck opening 140. The neck opening 140 may be defined by a collar 142. The dress body 110 may comprise a left arm opening 150. The dress body 110 may comprise a right arm opening 160. The dress body 110 may comprise a legs opening 170.

In some embodiments, the nursing garment 100 may further comprise an arm sleeve 152 coupled to the left arm opening 150. The left arm sleeve 152 may be a long sleeve or a short sleeve. The nursing garment 100 may further comprise a right arm sleeve 162 coupled to the right arm opening 160. The right arm sleeve 162 may be a long sleeve or a short sleeve.

In some embodiments, the front 120 may be coupled to the back 130 so as to form the collar 142, the neck opening 140, the left arm opening 150, the right arm opening 160 and the legs opening 170.

Figure 2:
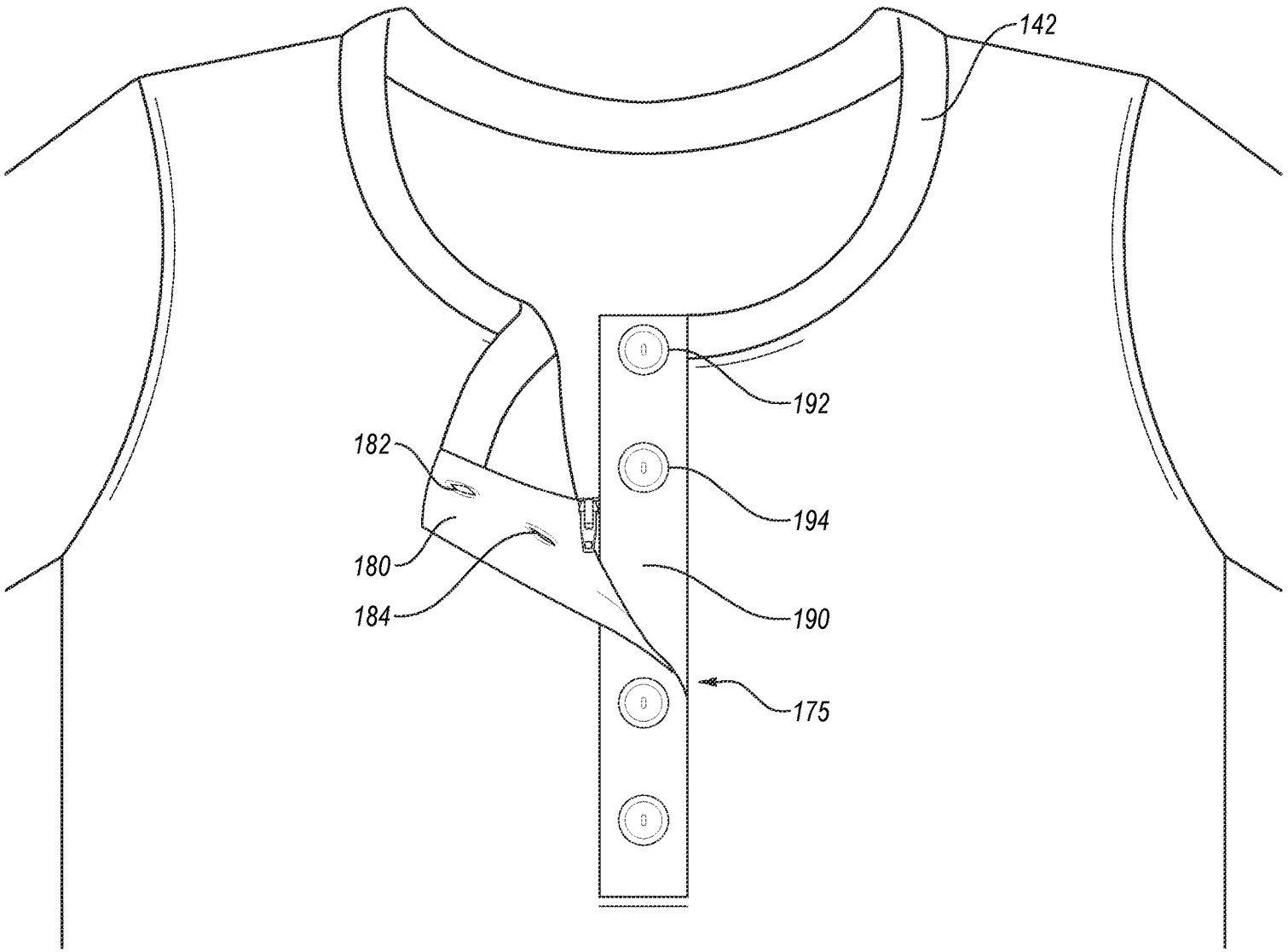
FIG. 2 is a frontal view of a nursing garment showing a partially opened placket in accordance with some embodiments described in this document.

In some embodiments, the dress body 110 may comprise a placket 175. Referring to FIG. 2, the placket 175 may comprise an upper placket 180. The upper placket 180 may extend from the collar 142 in the direction of the legs opening 170. Referring again to FIG. 1, in some embodiments, the upper placket 180 may extend a distance "A". The distance A may be about six inches, seven inches, eight inches, nine inches, ten inches, eleven inches or twelve inches. In further embodiments, the upper placket 180 may extend the length of the dress body 110.

Referring still to FIG. 2, in some embodiments the upper placket 180 may comprise at least one buttonhole 182. The at least one buttonhole 182 may comprise a reinforced stitched perimeter. Such reinforced stitched perimeter, for example, may prevent fraying and provide adequate support for a button.

In some embodiments, the at least one buttonhole 182 may be replaced by hook and loop, snaps, laces, and the like. Referring briefly to FIG. 5, examples of various buttonhole are illustrated in accordance with certain embodiments.

Referring again to FIG. 2, in some embodiments, the upper placket 180 may comprise a second buttonhole 184. The second buttonhole 184 may comprise a reinforced stitched perimeter. Such reinforced stitched perimeter, for example, may prevent fraying and provide adequate support for a button.

In some embodiments, the second buttonhole 184 may comprise hook and loop, snaps, laces, and the like.

In some embodiments, the at least one buttonhole 182 may further comprise a third buttonhole or a fourth buttonhole.

In some embodiments, the upper placket 180 may comprise at least one button 186. The at least one button 186 may be positioned below any of the buttonholes discussed above. The at least one button 186 may be coupled to the upper placket 180.

Referring still to FIG. 2, in some embodiments the placket 175 may comprise a lower placket 190. The lower placket 190 may extend from the collar 142 in the direction of the legs opening 170. In some embodiments, the lower placket 190 may extend a distance of about six inches, seven inches, eight inches, nine inches, ten inches, eleven inches or twelve inches. In some embodiments, the lower placket 190 may extend the length of the dress body 110. In some embodiments, the lower placket 190 may extend the same distance as the upper placket 180.

In some embodiments, the lower placket 190 may comprise at least one button 192. The at least one button 192 may be operable to couple with the buttonhole 182. In some embodiments, the at least one button 192 may comprise a hook and loop, snaps, laces, and the like. In some embodiments, the lower placket 190 may comprise a second button 194. The second button 194 may be replaced a second interlocking member. The second interlocking member may comprise hook and loop, snaps, laces, and the like.

In some embodiments, the at least one button 192 may further comprise a third button and a fourth button.

In some embodiments, the at least one button 192 may be operable to couple with the at least one buttonhole 182. Further, the second button 194 may be operable to couple with the second buttonhole 194. In some embodiments, the third button may be operable to couple with the third buttonhole. In some embodiments, the fourth button may be operable to couple with the fourth buttonhole.

In some embodiments, when a button and a buttonhole are coupled together, the upper placket 180 may be effectively coupled to the lower placket 190.

Figure 3:
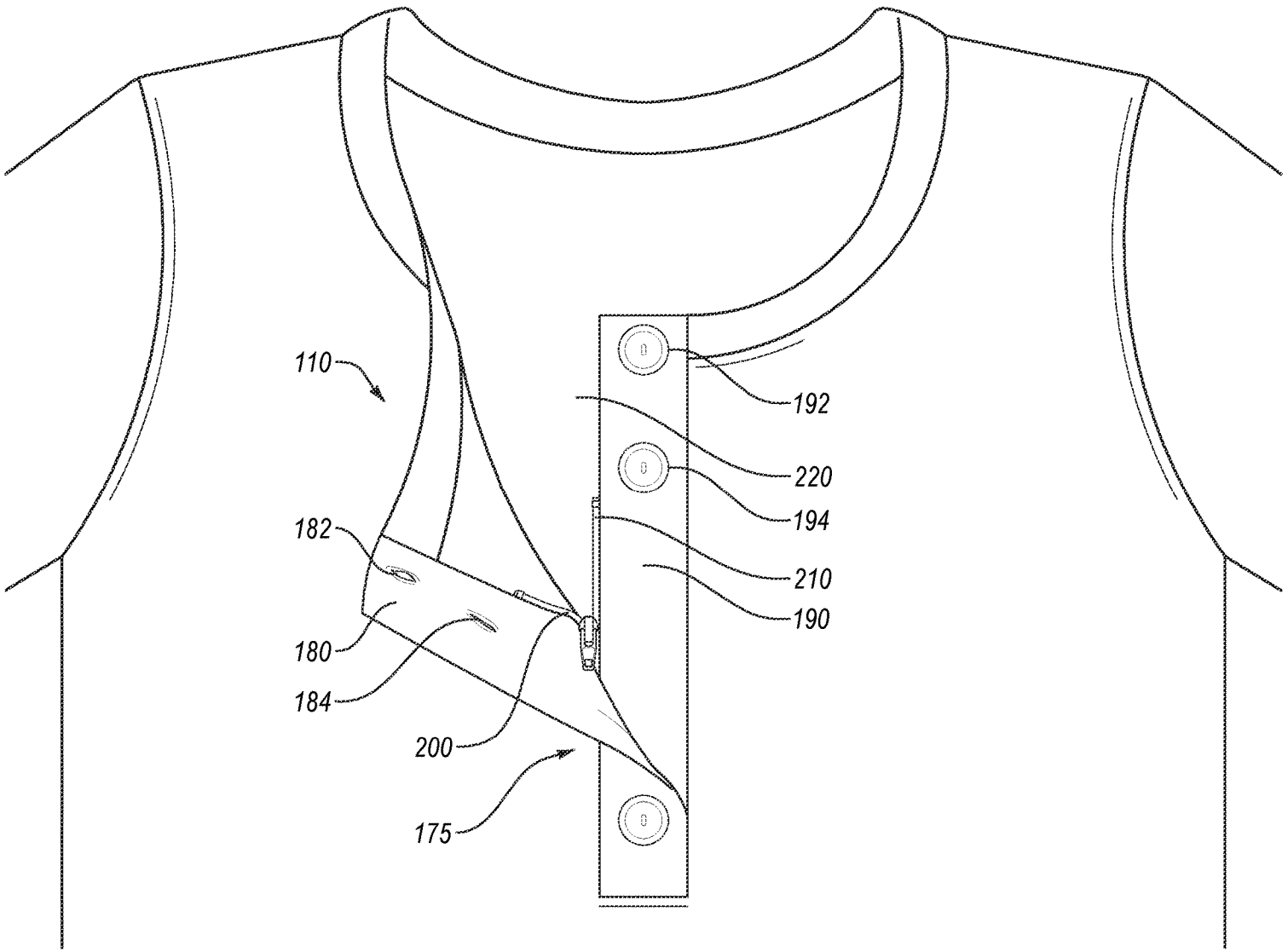
FIG. 3 is a frontal view of a nursing garment showing a partially opened placket in accordance with some embodiments described in this document.

Referring now to FIG. 3, in some embodiments, the dress body 110 may comprise a first zipper member 200. The first zipper member 200 may be coupled (e.g., sewn) to either or the upper placket 180 and the front 120.

In some embodiments, the dress body 110 may comprise a second zipper member 210. The second zipper member 210 may be coupled (e.g., sewn) to the lower placket 190. The second zipper member 210 may be operable to couple with the first zipper member 200.

In some embodiments, the upper placket 180 may be operable to substantially obscure the view of the first zipper member 200 and the second zipper member 210 when the upper placket 180 is coupled to the lower placket 190. When the first buttonhole 182 and the first button 192 are coupled together, the upper placket 180 may substantially obscure the view of the lower placket 190 and the first zipper 200 and the second zipper 210.

Figure 4A:
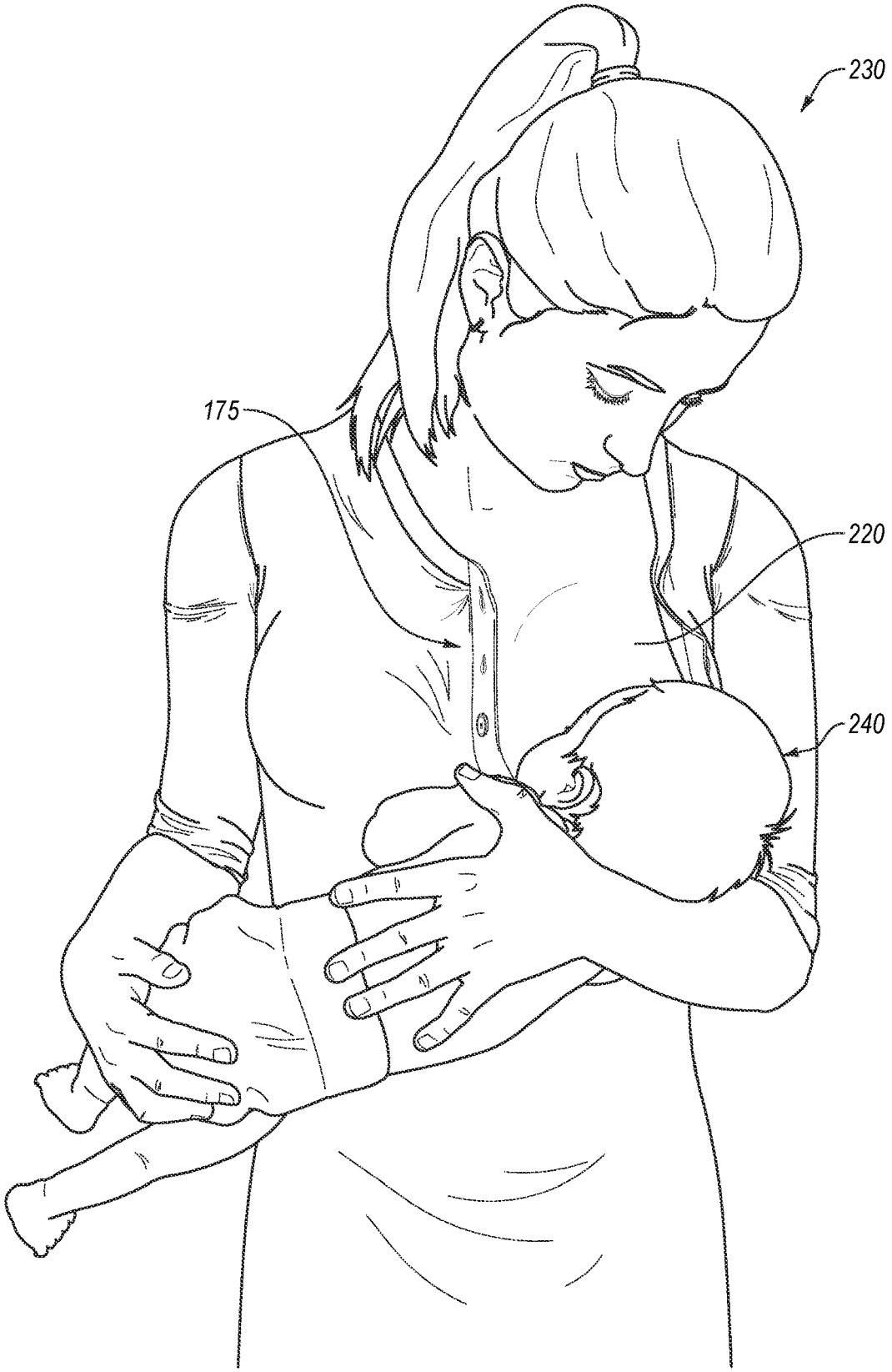
FIG. 4A is a front view of a woman breastfeeding a baby wearing a nursing garment in accordance with some embodiments described in this document.
Figure 4B:
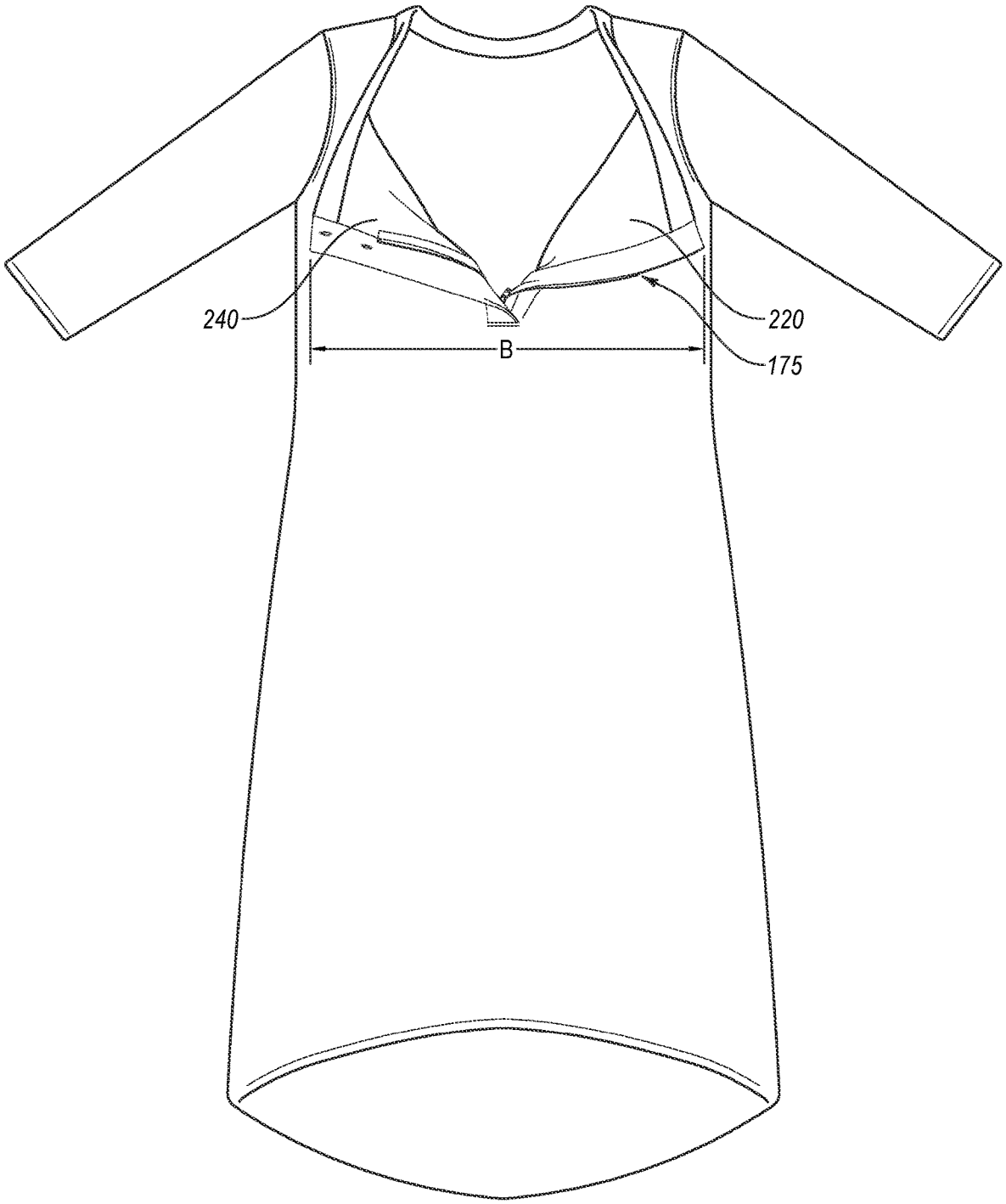
FIG. 4B is a front view of the nursing garment showing a fully opened placket.

Referring now to FIGS. 3 and 4A, and 4B, in some embodiments, the first zipper member 200 and the second zipper member 210 may be operable to decouple from each other. In some embodiments, the at least one buttonhole 182 may be operable to decouple from the at least one button 192. In some embodiments, the second buttonhole 184 may be operable to decouple from the second button 194. Upon decoupling the first zipper member 200 and the second zipper member 210 and upon decoupling the buttonhole and the button, the upper placket 180 and the lower placket 190 may be operable to separate from each other, thereby forming aperture 220. Aperture 220 may be operable to allow a wearer or user of the nursing garment 100 to nurse or feed an infant.

In some embodiments, when open the aperture 220 may have a distance "B" as shown in FIG. 4B. Distance "B" may include any width from about four inches up to sixteen, seventeen, eighteen, nineteen, or twenty inches.

In some embodiments, the first zipper member 200 may extend from below the at least a first buttonhole 182. In some embodiments, the first zipper member 200 may extend from below the at least a second buttonhole 184. In some embodiments, the first zipper member 200 may extend from below the third buttonhole. In some embodiments, the first zipper member 200 may extend from below the fourth buttonhole.

In some embodiments, the second zipper member 210 may extend from below the at least a first button 192. In some embodiments, the second zipper member 210 may extend from below the at least a second button 194. In some embodiments, the second zipper member 210 may extend from below the third button. In some embodiments, the second zipper member 210 may extend from below the fourth button.

Referring specifically to FIG. 4A, a woman 230 may open the placket 175 to form aperture 220. The woman 230 may accomplish this by decoupling the button 192 from buttonhole 182, decoupling button 194 from buttonhole 184, and decoupling the first zipper member 200 from the second zipper member 210. In some embodiments, the woman 230 could open one side of the dress body 110, in order to breastfeed infant 240. The aperture 220 may be, in some embodiments, partially opened, as illustrated in FIG. 4A. In some embodiments, as shown in FIG. 4*b*, both sides of the dress body 110 may be opened, such that the aperture 220 is opened to distance "B" per the comfort of the woman 230, allowing the woman 230 to breastfeed infant 240.

In some embodiments, the nursing garment 100 may be worn with normal undergarments, such as a bra. While feeding infant 240 the woman 230 may remove her undergarment from her breast via aperture 220, which may be large enough to allow the woman 230 to do so without the need of having to remove the nursing garment 100 in order to remove her undergarment.

In some embodiments, the nursing garment 100 may further comprise a shorter version of a nursing garment than the one described in the FIGS. Herein. For example, the nursing garment 100 may comprise a shirt or a formal top. Further, the nursing garment 100 may be worn as sleepwear.

In some embodiments, the nursing garment 100 may comprise a placket having an upper placket and a lower placket with associated buttonhole and zipper members. Such a placket may begin below a collar of the nursing garment and may extend down the garment. Further, such a placket may be offset to a right side or a left side of the nursing garment.

In some embodiments, the nursing garment 100 may comprise various styles, colors, patterns, and shapes. The nursing garment 100 may further comprise various different types of fabric, such as fabric that is comfortable, fabric that stretches easily, and other fabrics.

Unless otherwise specified, the term "substantially" means within 5% or 10% of the value referred to or within manufacturing tolerances. Unless otherwise specified, the term "about" means within 5% or 10% of the value referred to or within manufacturing tolerances.

The conjunction "or" is inclusive.

The terms "first", "second", "third", etc. are used to distinguish respective elements and are not used to denote a particular order of those elements unless otherwise specified or order is explicitly described or required.

Numerous specific details are set forth to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. A nursing garment, comprising:

a body having a front and a back, the body comprising:

a neck opening;

a left arm opening;

a right arm opening;

a lower opening;

an upper placket coupled with the front of the body that extends down a portion of the front; the upper placket comprising an inner edge coupled with the front of the body, an outer edge, and at least one buttonhole;

a lower placket coupled with the front of the body that extends down a portion of the front, the lower placket comprising an inner edge coupled with the front of the body and an outer edge;

a first button attached with the lower placket and operable to couple with the at least one buttonhole in the upper placket;

a first zipper member coupled to either or the upper placket and the front of the body; and a second zipper member coupled to the lower placket, the second zipper member being operable to couple with the first zipper member, wherein the upper placket and the lower placket are separable to allow an infant to nurse.

2. The nursing garment of claim 1, wherein the upper placket substantially obscures the view of the first zipper member and the second zipper member when the upper placket is coupled to the lower placket.

3. The nursing garment of claim 1, wherein the upper placket and the lower placket extend equal distances from the neck opening down the front.

4. The nursing garment of claim 1, wherein the upper placket and the lower placket are located on the front of the body equidistance from the left arm opening and the right arm opening.

5. The nursing garment of claim 1, wherein the upper placket and the lower placket are located on the front of the body and offset toward one of the left arm opening and the right arm opening.

6. The nursing garment of claim 1, wherein the first zipper member extends from below the at least one buttonhole and wherein the second zipper extends from below the at least one button.

7. The nursing garment of claim 1, wherein:

the at least one button comprises a second button on the lower placket, the second button being positioned below the at least one button;

the at least one buttonhole comprises a second buttonhole on the upper placket, the second buttonhole being positioned below the at least one buttonhole; and the second button and the second buttonhole are operable to couple together.

8. The nursing garment of claim 7, wherein the first zipper member extends from below the second buttonhole and wherein the second zipper member extends from below the second button.

9. The nursing garment of claim 7, wherein:

the at least one button comprises a third button on the lower placket, the third button being positioned below the second button;

the at least one buttonhole comprises a third buttonhole on the upper placket, the third buttonhole being positioned below the second buttonhole; and the third button and the third buttonhole are operable to couple together.

10. The nursing garment of claim 9, wherein:

the at least one button comprises a fourth button on the lower placket, the fourth button being positioned below the third button;

the at least one buttonhole comprises a fourth buttonhole on the upper placket, the fourth buttonhole being positioned below the third buttonhole; and the fourth button and the fourth buttonhole are operable to couple together.

11. A nursing garment, comprising:

a front;

a back coupled to the front, the front and the back forming a neck opening, a left arm opening, a right arm opening, and a lower opening; and a placket coupled to the front, comprising:

an upper placket comprising at least one buttonhole, a top end, and a bottom end;

a lower placket comprising at least one button operable to couple with the at least one buttonhole, a top end, and a bottom end, wherein the bottom end of the upper placket and the bottom end of the lower placket are coupled together with the front;

a first zipper member coupled to either or the upper placket and the front; and a second zipper member coupled to the lower placket, the second zipper member being operable to couple with the first zipper member, wherein the top end of the upper placket is coupled with the neck opening, and the top end of the lower placket is coupled with the neck opening;

wherein the bottom end of the upper placket and the bottom end of the lower placket are coupled with the front at the same location;

wherein the upper placket and the lower placket are separable to allow an infant to nurse.

12. The nursing garment of claim 11, wherein the front and the back comprise a stretchable fabric.

13. The nursing garment of claim 11, wherein the first zipper member extends from below the at least one buttonhole, wherein the second zipper extends from below the at least one button, and wherein the upper placket and the lower placket extend equal distances from the neck opening on the front panel down the front panel.

14. The nursing garment of claim 11, wherein:

the at least one button comprises a second button on the lower placket, the second button being positioned below the at least one button;

the at least one buttonhole comprises a second buttonhole on the upper placket, the second buttonhole being positioned below the at least one buttonhole; and the second button and the second buttonhole are operable to coupled together.

15. The nursing garment of claim 14, wherein the first zipper member extends from below the second buttonhole and wherein the second zipper extends from below the second button.

16. The nursing garment of claim 14, wherein the buttonholes comprise a reinforced stitched perimeter.

17. The nursing garment of claim 11, wherein the first zipper member is coupled to the upper placket and the second zipper member is coupled to the lower placket and wherein the upper placket obscures the view of the first zipper member and the second zipper member when joined together.

18. A nursing garment in the style of a shirt, comprising:

a shirt body having a front and a back, the dress body comprising:

a neck opening;

a left arm opening;

a right arm opening;

a lower opening;

an upper placket comprising a first interlocking member the upper placket extending from the neck opening to a position on the front that is about six to twelve inches below the neck opening, a lower placket comprising a second interlocking member operable to couple with the first interlocking member the lower placket extending from the neck opening to a position on the front that is about six to twelve inches below the neck opening and is coupled with the upper placket at the position;

a first zipper member coupled to either or the upper placket and the front; and a second zipper member coupled to the lower placket, the second zipper member being operable to couple with the first zipper member, wherein the upper placket and the lower placket are separable to allow an infant to nurse.

* * * * *